US012752889B2

(12) United States Patent
Bargende

(10) Patent No.: US 12,752,889 B2
(45) Date of Patent: Oct. 6, 2026

(54) FIN BEARING ASSEMBLY FOR A FIN STABILIZER

(71) Applicant: SKF MARINE GMBH, Hamburg (DE)

(72) Inventor: Dirk Bargende, Elmshorn (DE)

(73) Assignee: SKF MARINE GMBH, Hamburg (DE)

( * ) Notice: Subject to any disclaimer, the term of this patent is extended or adjusted under 35 U.S.C. 154(b) by 626 days.

(21) Appl. No.: 18/013,998

(22) PCT Filed: Jul. 6, 2021

(86) PCT No.: PCT/EP2021/068682

§ 371 (c)(1),
(2) Date: Jan. 6, 2023

(87) PCT Pub. No.: WO2022/013016

PCT Pub. Date: Jan. 20, 2022

(65) Prior Publication Data

US 2023/0286620 A1 Sep. 14, 2023

(30) Foreign Application Priority Data

Jul. 14, 2020 (DE) ..... 102020208773.3

(51) Int. Cl.
*B63B 39/06* (2006.01)

(52) U.S. Cl.
CPC ..... *B63B 39/06* (2013.01); *B63B 2039/067* (2013.01)

(58) Field of Classification Search
CPC . B63B 39/06; B63B 39/061; B63B 2039/065; B63B 2039/067
See application file for complete search history.

(56) References Cited

U.S. PATENT DOCUMENTS 3,036,540 A * 5/1962 Gregor ..... B63B 39/06 114/126
3,444,836 A * 5/1969 Rieprich ..... B63B 39/06 114/126
6,453,836 B1 9/2002 Ditmore
7,509,918 B2 * 3/2009 Lehmann ..... F16C 17/14 114/169

(Continued)

FOREIGN PATENT DOCUMENTS

CN 107600353 A 1/2018
DE 3731022 C2 2/1998

(Continued)

OTHER PUBLICATIONS

International Search Report and Written Opinion dispatched Jan. 20, 2022 for parent application No. PCT/EP2021/068682.

(Continued)

*Primary Examiner* — Ajay Vasudeva
(74) *Attorney, Agent, or Firm* — J-TEK LAW PLLC; Scott T. Wakeman; Mark A. Ussai

(57) ABSTRACT

A fin bearing assembly for a fin stabilizer of a watercraft includes a shaft for driving at least one fin of the fin stabilizer that is disposed coaxially in a trunk pipe, and the fin is rotatably supported radially outward on the trunk pipe by at least two fin bearings. The shaft for the rotating driving is connected inside the hull to a drive unit of the fin stabilizer by a transmission of the fin stabilizer such that the shaft and the transmission rotate together.

20 Claims, 1 Drawing Sheet

(56) References Cited

U.S. PATENT DOCUMENTS

| | | | | |
|---|---|---|---|---|
| 2010/0037809 | A1 | 2/2010 | Lehmann | |
| 2010/0083887 | A1 * | 4/2010 | Cappiello | ..... B63B 39/061 114/126 |

FOREIGN PATENT DOCUMENTS

| | | | | |
|---|---|---|---|---|
| DE | 202009001101 | U1 | 4/2009 | |
| GB | 888452 | A | 1/1962 | |
| GB | 954647 | A * | 4/1964 | |
| GB | 1011098 | A | 11/1965 | |
| JP | H05193568 | A | 8/1993 | |
| WO | WO-2011051388 | A1 * | 5/2011 | ..... B63H 25/38 |
| WO | 2013004678 | A1 | 1/2013 | |

OTHER PUBLICATIONS

Office Action from the German Patent Office dispatched Mar. 29, 2021 in related German application No. 10 2022 208 773.3, and translation thereof.

Office Action and Search Report from the Chinese Patent Office dispatched Apr. 17, 2025 in related application No. 202180047499, and translation thereof.

* cited by examiner

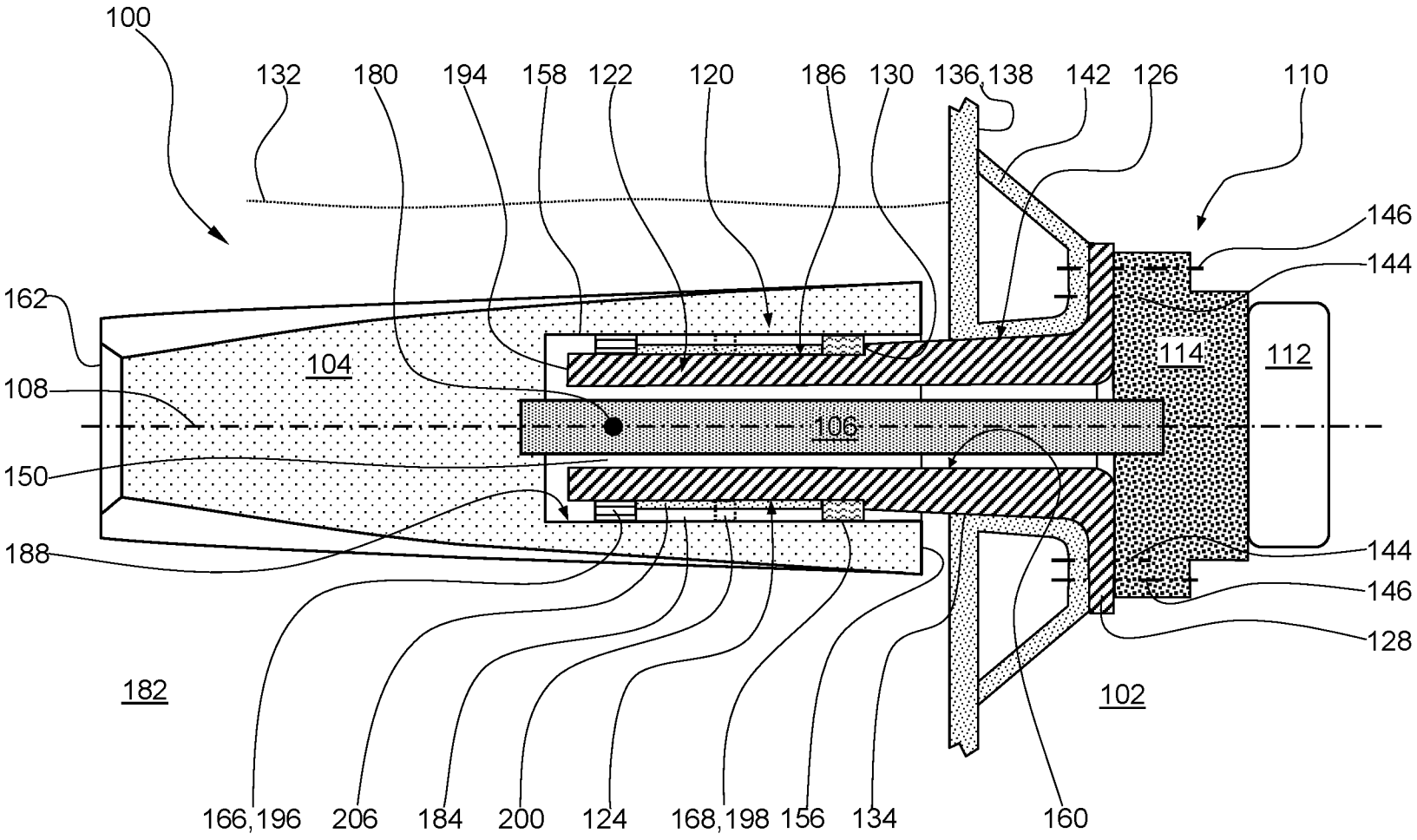
100
110
112
114
102
104
106
108
120
122
124
126
128
130
132
134
136
138
142
144
146
150
156
158
160
162
166,196
168,198
180
182
184
186
188
194
200
206

FIN BEARING ASSEMBLY FOR A FIN STABILIZER

CROSS-REFERENCE

This application is the U.S. National Stage of International Application No. PCT/EP2021/068682 filed on Jul. 6, 2021, which claims priority to German patent application no. 10 2020 208 773.3 filed on Jul. 14, 2020.

TECHNOLOGICAL FIELD

The invention relates to a fin bearing assembly for a fin stabilizer of a watercraft.

BACKGROUND

Fin stabilizers for passenger ships, larger yachts, boats, floating pontoons, etc. are known from the prior art in a wide range of variations. Highly precise direct drives, such as, for example, electric drives including a mechanical reducing transmission, are not currently used as drive for such fin stabilizers in the large ship range, which fin stabilizers have actuating forces of 30 kN and higher. High-precision electric drives generally require an additional coupling in order to make possible a decoupling of possibly occurring fin transverse forces and a compensation for inaccuracies in concentricity. Furthermore, a fin shaft of a conventional fin stabilizer transmits extremely high torques of up to 380 kNm, so that couplings suitable for this purpose require a very large installation space that is in many cases not available in watercraft. In addition, a coupling increases the installation and maintenance expense as well as the constructive complexity of the fin stabilizer and thus its probability of failure. Furthermore, a more stable or more solid and thus heavier fin shaft of a fin of a fin stabilizer also causes high acceleration forces due to its high inertia in operation., A particularly powerful electrical or electrohydraulic drive unit is therefore required for driving a fin stabilizer equipped with such a fin, which leads to high electricity consumption. Each fin stabilizer known from the prior art includes at least one stabilizing fin.

JP H05-193 568 A shows a fin bearing assembly with a trunk pipe on which a rudder blade is supported by at least two bearings. A rudder shaft is guided axially through the trunk pipe. DE 37 31 022 C2 shows a bearing assembly of a front fin in a sailing yacht. DE 20 2009 001 101 U1 shows a bearing assembly of a rudder blade using a trunk pipe through which a rudder shaft is guided. The rudder shaft supported in the trunk pipe by at least one neck journal bearing.

SUMMARY

An object of the invention is therefore to specify an improved fin bearing assembly for a fin stabilizer for a watercraft, which in particular has an increased energy efficiency and a constructively simplified and more compact construction.

The above-mentioned object is achieved by a shaft for driving at least one fin of the fin stabilizer being disposed coaxially in a trunk pipe, and the fin being rotatably supported radially outwardly on the trunk pipe using at least two fin bearings spaced axially with respect to each other. Possible lifting forces and resistance forces or transverse forces caused by the fin are thereby only supported by the trunk pipe, whereas the drive torques of the drive unit, and torques induced in the stabilizing fin by the surrounding water are exclusively transferred via the shaft. Consequently the shaft can have a significantly reduced diameter. Transverse forces are diverted via the trunk pipe and not transmitted into the shaft. Since the shaft reaches axially far into the stabilizing fin, the shaft can also be configured axially longer and thus more flexible. Consequently any misalignments, deformations of the fin stabilizer arising from operation, and manufacturing tolerances can be compensated for even without the presence of a mechanical (joint-) coupling. The inventive fin bearing assembly further allows transmissions that are not suitable for supporting transverse forces to operate in a coupling-free manner. Due to the considerably reduced diameter of the shaft for driving the fin, in comparison with conventional embodiments of fin stabilizers, the masses to be set in motion by the drive unit are reduced, which results in an increased energy efficiency of the fin stabilizer equipped with the inventive fin bearing assembly. This means an improved stabilizing effect with an unchanged power consumption of the electric drive unit, or a reduced power consumption with the same stabilizing effect in comparison with a conventional fin stabilizer including a solid fin shaft for driving the fin.

The trunk pipe preferably includes a flange that is connected to a hull skin of a hull of the watercraft. Consequently a particularly mechanically robust and resilient attaching of the trunk pipe to the hull of the watercraft is available. The unreleasable connection between the flange of the trunk pipe and the hull skin of the watercraft is preferably effected by welding or casting using a special method, such as, for example, the so-called Chockfast® method. A connecting region is preferably mechanically reinforced inside the hull between the flange of the trunk pipe and the hull skin of the watercraft by struts, gussets, or the like. A transmission of the electric drive unit is preferably connected to the flange of the trunk pipe using releasable attachment elements.

The shaft for the rotating driving is connected inside the hull to a drive unit of the fin stabilizer by a transmission of the fin stabilizer such that the shaft and the transmission rotate together. Consequently a problem free, inside installation of the fin stabilizer is possible. Since the trunk pipe receives all transverse forces, the shaft can have a reduced diameter and thus concomitantly an increased flexibility. Consequently a possible offset or misalignment between the fin bearing assembly and an output shaft of the transmission can be compensated for even without a (flexible) coupling, which results inter alia in a considerable reduction in installation space.

An essentially cylindrical receiving space for at least sectional receiving of the trunk pipe and the at least two fin bearings associated therewith is preferably formed in the region of an inner edge of the fin. Due to the supporting of the fin on the trunk pipe with the aid of the at least two fin bearings, an axially significantly shortened design results, since the fin bearing assembly is essentially realized inside the fin. The receiving space preferably extends axially up to a theoretical force application point or pressure point of the fin, or beyond. All lifting and resistance forces that arise due to the relative movement between the stabilizing fin and the water act at this theoretical force application point.

In the case of a further advantageous design, the trunk pipe includes a bearing section and a base section, wherein the at least two fin bearings are preferably disposed on the bearing section. Consequently a defined supporting of the fin on the bearing section of the trunk pipe is ensured outside the base section by the at least two fin bearings. Here the fin bearings are disposed in an annular space between the bearing section of the trunk pipe and an inner surface of the receiving space in the fin. In the case of one preferred design, the base section has a greater (outer) diameter than the bearing section so that a step or a shoulder arises between the bearing section and the base section, which step or shoulder can serve, for example, for one-side axial abutment of at least one fin bearing.

In the case of one favorable technical refinement, the first fin bearing is disposed in the region of a free trunk pipe. A greatest possible axial distance of the first fin bearing to the hull skin of the hull of the watercraft is thereby available.

The second fin bearing is preferably positioned in the region of the shoulder of the bearing section. Consequently the greatest possible axial distance to the first fin bearing is realized. The second fin bearing preferably abuts against the shoulder and is thereby simultaneously positionally secured on one side and securely guided.

In one favorable refinement, the first fin bearing is preferably configured as a sealed rolling-element bearing, in particular as a sealed spherical roller bearing, cylindrical roller bearing, or needle roller bearing. No water can thereby reach into an annular gap between the shaft and the trunk pipe surrounding it. In addition, a seal element can still be provided between the receiving space and the bearing section and/or the base section of the trunk pipe. The additional, optional seal element can be, for example, a radial seal ring or a shaft seal ring (so-called Simmerring®) or the like.

According to a further design, the second fin bearing is preferably realized with a water-lubricated plain bearing. Consequently a low bearing resistance and a small bearing clearance are realizable with a simultaneously very low maintenance expense and a long durability.

Alternatively the first and the second fin bearing could also be embodied as two sealed tapered roller bearings preloaded against each other. Due to this design, tilting moments of the fin can be optimally supported.

An annular gap preferably remains between the shaft and the trunk pipe. Due to the annular gap, a negligible friction resistance arises between the shaft and the trunk pipe coaxially surrounding it. Inside the fin bearing, friction losses are caused solely by the bearing resistance of the at least two fin bearings.

In the case of a further technically advantageous design, the at least two fin bearings are disposed on the bearing section of the trunk pipe axially spaced with respect to each other by at least one spacer. A defined and permanent axial distance between the at least two fin bearings disposed on the trunk pipe is thereby ensured.

BRIEF DESCRIPTION OF THE DRAWINGS

In the following a preferred exemplary embodiment of the invention is explained in more detail with reference to schematic FIGURES.

FIG. 1 shows a longitudinal section through a fin bearing assembly of a fin stabilizer.

DETAILED DESCRIPTION

A fin stabilizer 100 for a watercraft 102 not depicted in detail, such as a ship, a yacht, a boat, or a pontoon, comprises inter alia a fin 104 designed in a fluidically advantageous manner, which fin 104 is connected to a shaft 106 such that they rotate together. The shaft 106 is rotatable at least about its longitudinal central axis 108 using a preferably electric drive unit 110 for achieving the desired stabilizing effect, in particular for the roll-stabilizing of the watercraft. The preferably electric drive unit 110 comprises inter alia an electric motor 112 including a downstream, speed-reducing transmission 114, which can be realized, for example, by an axially compact eccentric transmission, or a cycloidal transmission, or an epicyclic transmission. The transmission 114 is connected to the shaft 106 such that they rotate together, but are releasable.

An inventive fin bearing assembly 120 of the fin stabilizer 100 comprises a so-called trunk pipe 122 or cladding tube. The heavy and solid trunk pipe 122 comprises a bearing section 124 lying outside the hull, and a base section 126 that merges into a flange 128 arranged annularly here only by way of example and inside the hull in the watercraft 102. The base section 126 extends sectionally inside the hull, while the bearing section 124, merely by way of example here, extends completely inside the hull. Between the preferably larger diameter and essentially slightly conical base section 126 and the preferably smaller diameter and approximately cylindrical bearing section 124, a small shoulder 130 or a step or a recess arises that can serve as a one-side axial abutment for at least one fin bearing. Differently from the step-type design depicted in FIG. 1 merely by way of example, the shoulder 130 can also be configured conical or fillet-shaped. Analogously to the base section 126, the bearing section 124 can also be configured slightly conical. The bearing section 124 and the base section 126 can optionally merge into each other in a step-free or shoulder-free manner. Furthermore, it is possible that the base section 126 and/or the bearing section 124 have a slightly radially inwardly curved or fillet-shaped outer contour, so that starting from flange 128 up to a free end of the trunk pipe 122, the trunk pipe 122 is slightly tapered.

If required, the flange 128 of the fin stabilizer 100, which flange 128 is disposed inside the hull, can have a pot-shaped geometry (not depicted). Between the smaller-diameter bearing section 124 and the larger-diameter base section 126 of the trunk pipe 122, a shoulder 130 or a step or a recess is formed here merely by way of example.

Below a water surface 132, the slightly conical base section 126 of the trunk pipe is guided through an opening 134 in a hull skin 136 of a hull 138 of the watercraft 102. A reinforcement 142 in the shape of struts, profiles, gussets or the like is preferably formed inside the hull on the hull skin 136. The flange 128 of the trunk pipe 122 is welded or otherwise unreleasably connected inside the hull with the hull skin 136 and/or the reinforcing 142. In addition, the flange 128 can be connected to the inside-the-hull reinforcement 142 using releasable attachment means 144 uniformly circumferentially spaced with respect to one another. The transmission 114 is for its part preferably releasably connected to the flange 128 of the trunk pipe 122 with the aid of a plurality of attachment means 146 uniformly circumferentially spaced with respect to one another.

The shaft 106 is disposed spaced coaxially in the trunk pipe 122 with creation of an annular gap 150 and can rotate therein practically without resistance. The annular gap 150 is located between the shaft 106 and a cylindrical inner surface 160 of the trunk pipe 120.

Starting from an inner edge 156 or a fin root of the fin 104, an essentially cylindrical receiving space 158 is formed for at least sectional receiving of the trunk pipe 122 and the fin bearing 166, 168 positioned thereon. Using the fin bearings 166, 168, the fin 104 is rotatably supported on the trunk pipe 122 or its bearing section 124. In view of the extremely high hydrodynamic and hydrostatic forces, and torques of up to 380 kNm, acting on the fin 104, more than the two fin bearings 166, 168 shown here merely by way of example can be provided.

Starting from the inner edge 134 toward an outer edge 162 or a fin tip of the fin 104, the receiving space 158 inside the fin 104, which receiving space 158 coaxially encloses at least the bearing section 124 and, at least sectionally, the base section 126, extends in the axial direction, i.e., parallel to the longitudinal central axis 108 of the shaft 106. All hydraulic lifting and resistance forces that are caused by the water 182 surrounding the fin 104 act at a theoretical force application point 180. When, as shown here, the force application point 180 is positioned axially in the region of the first fin bearing 166, an optimal transmission of the hydrostatic and hydrodynamic forces acting on the fin 104 into the trunk pipe 122 results, and thus as a result into the hull 138 of the watercraft 102.

According to the invention there is a strict separation between hydraulically triggered transverse forces caused by the fin 104, which transverse forces are exclusively transmitted from the trunk pipe 122 into the hull 138 of the watercraft 102, and torques that are only transferred bidirectionally between the fin 104 and the transmission 114 of the drive unit 112. The first and the second fin bearing 166, 168 are located in an annular space 184 that is between an outer surface 186 of the bearing section 124 of the trunk pipe 122, and an inner surface 188 of the receiving space 158.

The first fin bearing 166 is preferably disposed in the vicinity of a free trunk-pipe end 194 and preferably configured as a locating bearing, while the second fin bearing 168 is preferably positioned in the region of the shoulder 130 and is preferably configured as a non-locating bearing for compensation of axial movements. Here the second fin bearing 168 abuts laterally against the shoulder 130, whereby at least one one-side axial positional securing of the second fin bearing 168 is ensured. Securing means for the axial position-fixing of the at least two fin bearings 166, 168 on the trunk pipe 122, such as, for example, spring rings, Seeger® rings, clamping rings, shaft nuts, or the like, are not depicted for the sake of improved graphic overview. Due to the above-described arrangement of the two fin bearings 166, 168 depicted merely exemplarily here, these are positioned at a greatest-possible axial distance on the bearing section 124 of the trunk pipe 122, which results in a highest-possible capacity of the fin bearing assembly 120 for receiving applied transverse forces via the trunk pipe 122.

The first fin bearing 166 is preferably embodied as a sealed rolling-element bearing 196, in particular as a sealed spherical roller bearing for tolerance and angular compensation, or as a sealed cylindrical roller bearing or needle bearing for minimizing the required volume of the annular space 184. The penetrating of water 182 into the annular gap 150 of the fin bearing assembly 120 is prevented by this embodiment. The second fin bearing 168 is preferably embodied with a water-lubricated plain bearing 198 that ensures a long service life with a simultaneously minimal maintenance expense.

For optimizing the sealing effect of the rolling-element bearing 196 and for increasing the reliability of the seal of the seal of the fin bearing 120, at least one, for example, annular seal element 200, can be provided between the first fin bearing 166 and the second fin bearing 168. This seal element 200 can be realized, for example, using a radial seal ring or a shaft seal ring (so-called Simmerring®), including a stuffing box or the like.

Furthermore, a, for example, hollow-cylindrical spacer 206 can be provided between the first fin bearing 166 and the second fin bearing 168 on the cylindrical bearing section 124 of the trunk pipe 122, in order to achieve a permanent and reliable axial spacing of the two fin bearings 166, 168 on the bearing section 124 of the trunk pipe 122. Here the spacer 206 is exposed to the water 182 and is correspondingly configured corrosion-resistant or seawater-resistant.

The fin bearing assembly 120 makes possible, inter alia, a considerable reduction of the mass of the parts moving in operation of the fin stabilizer 100 in the form of the fin 104, the shaft 106, the transmission 114, and the electric drive unit 110. A significant reduction of the energy requirement thereby results with a constant stabilizing power of the fin stabilizer 100 in comparison to previously known solutions, or an improvement of the stabilizing power with constant energy requirement, for example, in the form of electricity for powering the electric motor 112 of the electric drive unit 110 of the fin stabilizer 100.

In addition, in connection with the fin bearing 120, transmission designs that are not suitable for or intended for the supporting of transverse forces that arise due to the hydromechanical lifting and/or the hydraulic resistance of the fin 104 in the water, can be used in a coupling-free manner. The long and relatively thin shaft 106 of the fin bearing assembly 120 simultaneously acts as a compensator for any misalignments that arise inter alia due to manufacturing tolerances and due to elastic deformations of the complete structure of the fin stabilizer 100 due to the extremely high hydrodynamic and hydrostatic forces acting on the fin 104.

The invention relates to a fin bearing assembly 120 for a fin stabilizer 100 of a watercraft 102. According to the invention, a shaft 106 for driving at least one fin 104 of the fin stabilizer 100 is disposed coaxially in a trunk pipe 122, and the fin 104 is rotatably supported radially outward on the trunk pipe 122 using at least two fin bearings 166, 168 spaced axially with respect to each other. The fin bearing assembly 120 makes possible an improved energy efficiency of the fin stabilizer 100 thus equipped. Furthermore, a transmission 114 not suitable for the receiving of high transverse forces can be used inside the drive unit 110 of the fin stabilizer 100. In addition, the solid trunk pipe 122 allows a decoupling between the transmission of transverse forces onto the hull 138 of the watercraft 102, and the bidirectional transfer of torques between the fin 104 and the drive unit 110. A diameter reduction of the (drive-) shaft 106 is thereby possible. At the same time the axial length of the shaft 106 is increased by the engaging of the trunk pipe 122 into the receiving space 158 of the fin 104. The flexibility of the shaft 106 thereby increases so that possible misalignments and manufacturing tolerances can be compensated even without the presence of a coupling.

REFERENCE NUMBER LIST

100 Fin stabilizer
102 Watercraft
104 Fin
106 Shaft
108 Longitudinal central axis
110 Drive unit
112 Electric motor
114 Transmission
120 Fin bearing assembly
122 Trunk pipe
124 Smaller-diameter bearing section (trunk pipe)
126 Larger-diameter base section (trunk pipe)
128 Flange

130 Shoulder
132 Water surface
134 Opening
136 Hull skin
138 Hull (watercraft)
142 Reinforcing
144 Attachment means (flange)
146 Attachment means (transmission)
150 Annular gap
156 Inner edge (fin)
158 Receiving space (fin)
160 Cylindrical inner surface (trunk pipe)
162 Outer edge (fin)
166 First fin bearing
168 Second fin bearing
180 Force application point (pressure point)
182 Water
184 Annular space
186 Outer surface (trunk pipe)
188 Inner surface (receiving space)
194 Trunk-pipe end
196 Sealed rolling-element bearing (spherical roller bearing, cylindrical roller bearing needle roller bearing)
198 Water-lubricated plain bearing
200 Seal element
206 Spacer

The invention claimed is:

1. A fin bearing assembly for a fin stabilizer of a watercraft comprising:

a trunk pipe having a first portion configured to be mounted inside a hull and a second portion configured to extend outside the hull, the trunk pipe also including an interior and a radially exterior surface, a one-piece shaft coaxially disposed in the interior of the trunk pipe and having a first end and a second end and a longitudinal axis about which the shaft is rotatable, a fin mounted on the shaft for rotation with the shaft and relative to the trunk pipe, a first fin bearing and a second fin bearing between the radially exterior surface and the fin, the first and second fin bearings supporting the fin on the radially exterior surface of the trunk pipe, and a transmission connected to the first portion of the trunk pipe and a drive unit connected to the transmission, wherein the drive unit is configured to rotate the shaft via the transmission, wherein the first end is engaged with an output of the transmission and the second end is engaged with the fin, and wherein the first portion of the trunk pipe includes an annular flange that is configured to be connected to a hull skin of the hull of the watercraft.

2. The fin bearing assembly according to claim 1, wherein the second fin bearing is a water-lubricated plain bearing.

3. The fin bearing assembly according to claim 1, wherein the shaft is spaced from the trunk pipe by an annular gap.

4. The fin bearing assembly according to claim 1, wherein the first and second fin bearings are axially spaced from each other by at least one spacer.

5. The fin bearing assembly according to claim 1, wherein the fin includes a substantially cylindrical interior space open to a root end of the fin, wherein at least a portion of the trunk pipe extends into the interior, and wherein the first and second fin bearings are located in the interior.

6. The fin bearing assembly according to claim 1, wherein the transmission is a speed-reducing transmission.

7. The fin bearing assembly according to claim 1, wherein the transmission is releasably connected to the shaft.

8. The fin bearing assembly according to claim 1, wherein the annular flange delimits an end of the trunk pipe and is perpendicular to the axis of rotation.

9. The fin bearing assembly according to claim 8, wherein the annular flange surrounds the one-piece shaft, and wherein the one-piece shaft passes completely through the annular flange.

10. The fin bearing assembly according to claim 9, wherein the transmission is mounted on a planar portion of the annular flange.

11. The fin bearing assembly according to claim 1, wherein the one-piece shaft passes completely through the annular flange.

12. The fin bearing assembly according to claim 11, including an electric motor operatively connected to the transmission.

13. A watercraft comprising:

a hull having an external surface configured to contact water in which the watercraft is floatable and having an internal surface defining a boundary of a hull interior, the hull interior being sealed from the water when the watercraft floats in the water; and a fin bearing assembly according to claim 12, wherein the drive unit is configured to rotate the shaft via the transmission, wherein the first end of the shaft is engaged with an output of the transmission and the second end of the shaft is engaged with the fin, and wherein the annular flange is located in the hull interior and is mounted to a reinforcing body in the hull interior, the reinforcing body being connected to the hull internal surface.

14. The watercraft according to claim 13, wherein the flange delimits an end of the trunk pipe and is perpendicular to the axis of rotation.

15. The watercraft according to claim 14, wherein the annular flange surrounds the one-piece shaft, and wherein the one-piece shaft passes completely through the annular flange.

16. The watercraft according to claim 14, wherein the annular flange surrounds the one-piece shaft, and wherein the one-piece shaft passes completely through the annular flange.

17. The watercraft according to claim 13, wherein the one-piece shaft passes completely through the annular flange.

18. The fin bearing assembly according to claim 17, including an electric motor operatively connected to the transmission.

19. The watercraft according to claim 13, wherein the flange is connected to the inner side of the hull by an unreleasable connection.

20. The watercraft according to claim 19, wherein the transmission is releasably mounted on the flange, and wherein the transmission comprises a speed-reducing transmission.

* * * * *